US006095068A

United States Patent [19]

Hori

[11] Patent Number: 6,095,068

[45] Date of Patent: Aug. 1, 2000

[54] EMBROIDERY FRAME

[75] Inventor: Takeyoshi Hori, Yokkaichi, Japan

[73] Assignee: Brother Kogyo Kabushiki Kaisha, Nagoya, Japan

[21] Appl. No.: 09/317,173

[22] Filed: May 24, 1999

[30] Foreign Application Priority Data

Jun. 10, 1998 [JP] Japan ..... 10-162128

[51] Int. Cl.[7] ..... D05C 09/04; D06C 03/08

[52] U.S. Cl. ..... 112/103; 38/102.2

[58] Field of Search ..... 112/103; 38/102, 38/102.2, 102.1, 102.91

[56] References Cited

U.S. PATENT DOCUMENTS

| | | | |
|---|---|---|---|
| 4,079,529 | 3/1978 | Jennen et al. | 38/102.2 |
| 4,247,998 | 2/1981 | Foss | 38/102.2 |
| 4,411,208 | 10/1983 | Nishida et al. | 112/103 |
| 4,642,924 | 2/1987 | Sudderth et al. | 112/103 X |
| 5,819,675 | 10/1998 | French et al. | 112/103 |

FOREIGN PATENT DOCUMENTS 61-389 1/1986 Japan .

*Primary Examiner*—Ismael Izaguirre
*Attorney, Agent, or Firm*—Oliff & Berridge, PLC

[57] ABSTRACT

An embroidery frame includes of an outer frame attached to a driving unit of a frame drive mechanism, and an inner frame that cooperates with the outer frame to hold a work cloth therebetween. An engaging recess is provided on at least one of the outer frame segments of the outer frame other than that including a split portion, and an engaging protrusion capable of engaging with the engaging recess is formed in at least one of inner frame segments of the inner frame. Thus, the user is able to easily determine the front and rear sides of the outer frame. Even if the user places the inner frame upside down by mistake, the inner frame cannot be uniformly fitted in the outer frame due to the presence of the engaging protrusion, thus notifying the user of the mistake in the orientation of the outer frame and inner frame. Because the outer frame can be tightly fastened, until separate end portions of the split portion almost abut on each other, by means of a fastening mechanism with no interference with the engaging protrusion, the work cloth as a whole can be stretched over an aperture of the embroidery frame with substantially uniform tensile force.

20 Claims, 10 Drawing Sheets

EMBROIDERY FRAME

BACKGROUND OF THE INVENTION

1. Field of Invention

The invention relates to an embroidery frame that comprises an outer frame to be attached to a driving unit of a frame drive mechanism of an embroidery sewing machine, and an inner frame that cooperates with the outer frame to hold a work cloth therebetween.

2. Description of Related Art

There are currently household embroidery sewing machines that incorporate embroidery devices and are capable of performing embroidery sewing operations, and household embroidery sewing machines to which embroidery devices may be optionally attached to enable embroidery sewing operations. By setting a work cloth in an embroidery frame and attaching the frame to a drive unit of the embroidery device, the above type of sewing machine is able to form desired embroidery patterns on the work cloth.

For use with the above-described embroidery sewing machines, various embroidery frames having different sizes are prepared depending upon the area of a desired embroidery region in which an embroidery pattern can be formed. As for the shape of the embroidery frame, those having a generally rectangular shape or generally circular shape have been widely used in practical applications. A typical embroidery frame consists of an outer frame to be attached to the drive unit of the embroidery device, and an inner frame that cooperates with the outer frame to sandwich a work cloth therebetween. Each of the inner and outer frames has predetermined front and rear sides or faces.

More specifically, the outer frame is equipped with a coupling member to be connected to the driving unit of the embroidery device, and therefore the front and rear sides of the outer frame are predetermined depending upon the mounting position or orientation of the coupling member relative to the outer frame, and mounting conditions that allow the inner frame to be easily fitted in the outer frame. On the other hand, the inner frame is formed with ribs so that the work cloth can be securely held between the inner and outer frames, to stretch over an opening defined by the frames without forming creases on the cloth set in the frames, thus preventing the work cloth from being loosened during embroidery sewing. Thus, the front and rear sides of the inner frame are also predetermined depending upon the location of the ribs.

Embroidery frames are often supplied as accessories with sewing machines capable of embroidery sewing and currently available in the market. Although the user's guide or manual provides brief instructions on how to use the embroidery frame, the user is apt to be confused at a glance into thinking that the embroidery frame has no front and rear sides. In fact, it is difficult for the user to tell or determine the front and rear sides of the embroidery frame only by looking at it for a short time. Accordingly, if the user is a beginner, and not accustomed to embroidery sewing operations, he/she is liable to make a basic mistake, by placing the outer frame on a table such that its rear side faces upward, laying a work cloth over the outer frame, and finally fitting the inner frame into the outer frame such that the rear side of the inner frame faces upwards. Since the embroidery frame cannot be attached to the driving unit of the embroidery device unless it is correctly oriented, the user may turn the embroidery frame upside down, and attach the frame to the embroidery device such that the front side of the outer frame faces upwards.

In the above case, the work cloth is set from the rear side of the embroidery frame while the rear sides of the outer frame and inner frame face are facing upwards, namely, the embroidery frame is oriented upside down, and then attached to the drive unit of the embroidery device in the normal state in which the front side of the outer frame faces upwards, namely, the embroidery frame is placed upside down. As a result, the work cloth is stretched over the upper face of the embroidery frame, and a sewing operation is performed on the work cloth that is being held at a position higher than that of the needle plate. This may cause such problems that a sewing needle that is driven in the vertical direction is undesirably caught by the work cloth, with the results that the cloth is torn apart, the needle is broken, or embroidery stitches are cut off by the sewing needle.

FIG. 11 shows a known example of embroidery frame (supplied with a sewing machine whose model number is HZL-008NIAT-5800, available from Tokyo Juki Industrial Co., Ltd.). The embroidery frame 100 consists of an outer frame 200 and an inner frame 300. The outer frame 200 is provided at one location thereof with a split portion 204, which can be fastened by a fastening mechanism 202. It is to be noted that no recessed portion other than the split portion 204 is provided on the circumference of the frame. On the other hand, the inner frame 300 includes a positioning protrusion 302 formed at one location on the side face of the frame, and a tab 304 formed on the upper face of the frame such that the tab 304 extends outwardly of the frame while slightly protruding upwards. When the inner frame 300 is correctly oriented and fitted in the outer frame 200, the protrusion 302 comes to be located in a clearance 206 of the split portion 204 of the outer frame 200. This arrangement makes it easy for the user to determine the front and rear sides of the inner frame 300, and prevents the inner frame 300 from being reversed and fitted in the outer frame 200 in the reversed state.

In the conventional embroidery frame 100 as described above, however, the split portion 204 of the outer frame 200 must provide a sufficiently large size of clearance 206. Therefore the tension of the cloth may be reduced in the vicinity of the split portion 204. Namely, a part of the cloth that faces the clearance 206 of the split portion 204 of the outer frame 200 is not sandwiched between the outer frame 200 and the inner frame 300, and only the inner frame 200 serves to support this part of the cloth to stretch it over the opening of the frame. In this part of the cloth having reduced tension creases are likely to appear, which may cause a problem during embroidery sewing.

SUMMARY OF THE INVENTION

It is therefore an object of the invention to provide an embroidery frame which allows the user to easily determine the front and rear sides of the inner and outer frames, thus surely avoiding a mistake that would otherwise occur when setting a work cloth in the embroidery frame, and which enables the entire cloth to be stretched with a substantially uniform tensile force.

To accomplish the above object, the invention provides an embroidery frame for an embroidery machine, comprising an outer frame to be attached to a driving unit of a frame drive device, the outer frame including a split portion formed at least at one location as viewed in a circumferential direction thereof, the split portion including a pair of separate end portions; an inner frame that cooperates with the outer frame to sandwich a work cloth therebetween; and a fastening mechanism operable to fasten the pair of separate end portions of the split portion of the outer frame in such a direction that the separate end portions approach each other, wherein an engaging recess is formed in a portion of one of the outer frame and the inner frame that excludes the split portion, and an engaging protrusion adapted to engage with the engaging recess is formed on the other of the outer frame and the inner frame.

In the case where the user places the outer frame upside down by mistake, with the engaging recess or protrusion of the outer frame facing downwards, the engaging protrusion or recess provided on the inner frame cannot engage with the engaging recess or protrusion of the outer frame when the user attempts to fit the inner frame into the outer frame, and he/or she will notice that the outer frame was placed upside down. Where the outer frame is correctly placed with its front side facing upwards, and the user attempts to fit the inner frame into the outer frame with the inner frame being wrongly oriented upside down, the entire body of the inner frame cannot be uniformly fitted into the outer frame. Therefore the user will notice that the inner frame was positioned with its front and rear sides being reversed. In this manner, the user is notified of his/her mistake in the orientation of the outer frame and inner frame.

In the embroidery frame as described above, the engaging recess is formed in one of the outer frame and inner frame at a position thereof other than the split portion of the outer frame. In this case, the engaging protrusion engages with the engaging recess at the position other than the split portion, thus allowing the fastening mechanism to fasten the split portion until its separate end portions substantially abut on each other with almost no clearance therebetween. With this arrangement, the entire cloth can be stretched over the frame with an almost uniform force, without suffering from reduction in the tension of the cloth in the vicinity of the split portion, or creases that would otherwise result from variations in the tension of the cloth.

In one preferred form of the invention, the engaging recess is located at a position on the embroidery frame that is substantially opposed to a position on the frame to which the fastening mechanism is attached. With this arrangement, after the engaging recess and protrusion are brought into engagement with each other on the frame segment that is opposed to the fastening mechanism, the outer frame may be fastened to the inner frame by means of the fastening mechanism that is spaced apart from the engaging recess and protrusion. Thus, the engaging operation for engaging the recess with the protrusion can be easily accomplished without being interrupted by the fastening mechanism.

In another preferred form of the invention, each of the outer frame and the inner frame has a generally rectangular shape, and the engaging recess is formed in one of the frame segments other than that to which the fastening mechanism is attached. With this arrangement, the outer frame can be fastened onto the inner frame by the fastening mechanism after the engaging recess and engaging protrusion are brought into engagement with each other on the frame segment located remote from the engaging mechanism, which facilitates the operation to attach the cloth to the embroidery frame.

Where the engaging recess is located at a position that is spaced from a middle portion of the relevant frame segment as viewed in a longitudinal direction thereof, the engaging protrusion is also located at the position that is spaced from the middle portion of the corresponding frame segment, thus notifying the user of the front and rear sides of the outer and inner frames at a glance.

In a further preferred form of the invention, a plurality of pairs of engaging recesses and protrusion are provided on the embroidery frame. In this case, the plurality of engaging portions achieve more reliable engagement between the inner and outer frames, and thus facilitates the operation to attach the work cloth to the frame.

In another preferred form of the invention, the engaging recess is provided on the side of the upper face of the outer frame, while the engaging protrusion is provided on the inner frame. With this arrangement, when the inner frame is mounted in the outer frame from above, no protrusion that would protrude inwardly of the frame is provided on the outer frame, and therefore the inner frame can be easily fitted in the outer frame. Thus, the work cloth to be held by the embroidery frame can be set between the outer and inner frame such that the cloth stretches over the frame to provide a smooth surface.

Where a tab is provided which protrudes outwardly of the outer periphery of the inner frame, the inner frame may be easily detached from the outer frame by holding the tab with a hand and pulling it upwards.

In a still another preferred form of the invention, the engaging recess and the engaging protrusion snugly engage with each other with substantially no clearance therebetween. In this case, the outer and inner frames are fixed to each other at the engaging recess and protrusion, and therefore the inner frame can be easily fitted into the outer frame.

BRIEF DESCRIPTION OF THE DRAWINGS

The invention will be described in greater detail with reference to preferred embodiments thereof and the accompanying drawings, wherein.

DETAILED DESCRIPTION OF PREFERRED EMBODIMENTS

One preferred embodiment of the invention will be described in detail with reference to the accompanying drawings. In the embodiment, the invention is applied to an embroidery frame to be attached to a frame drive device of an electronically controlled embroidery sewing machine capable of forming various embroidery patterns.

Figure 1:
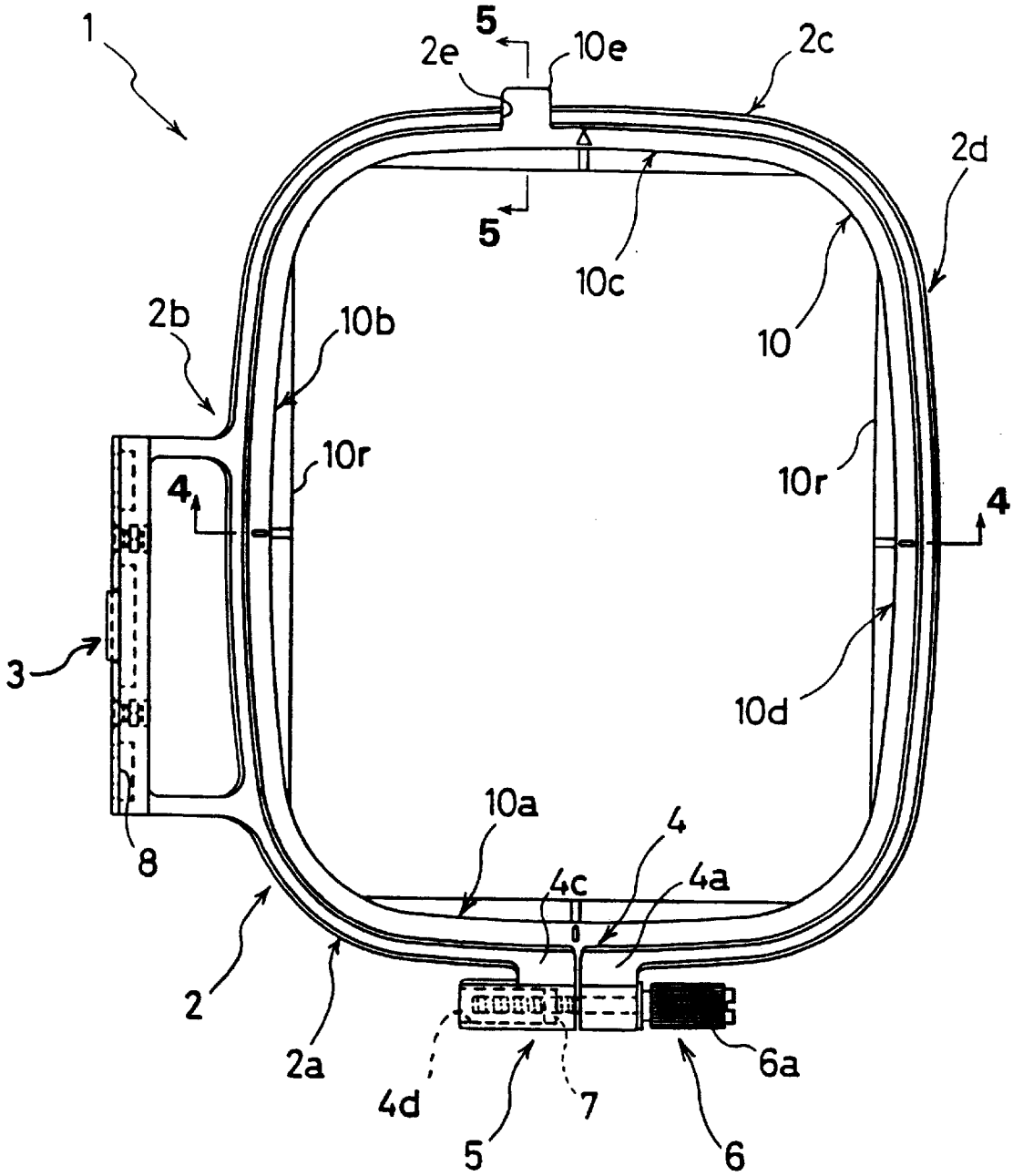
FIG. 1 is a plan view showing an embroidery frame according to one embodiment of the invention.
Figure 2:
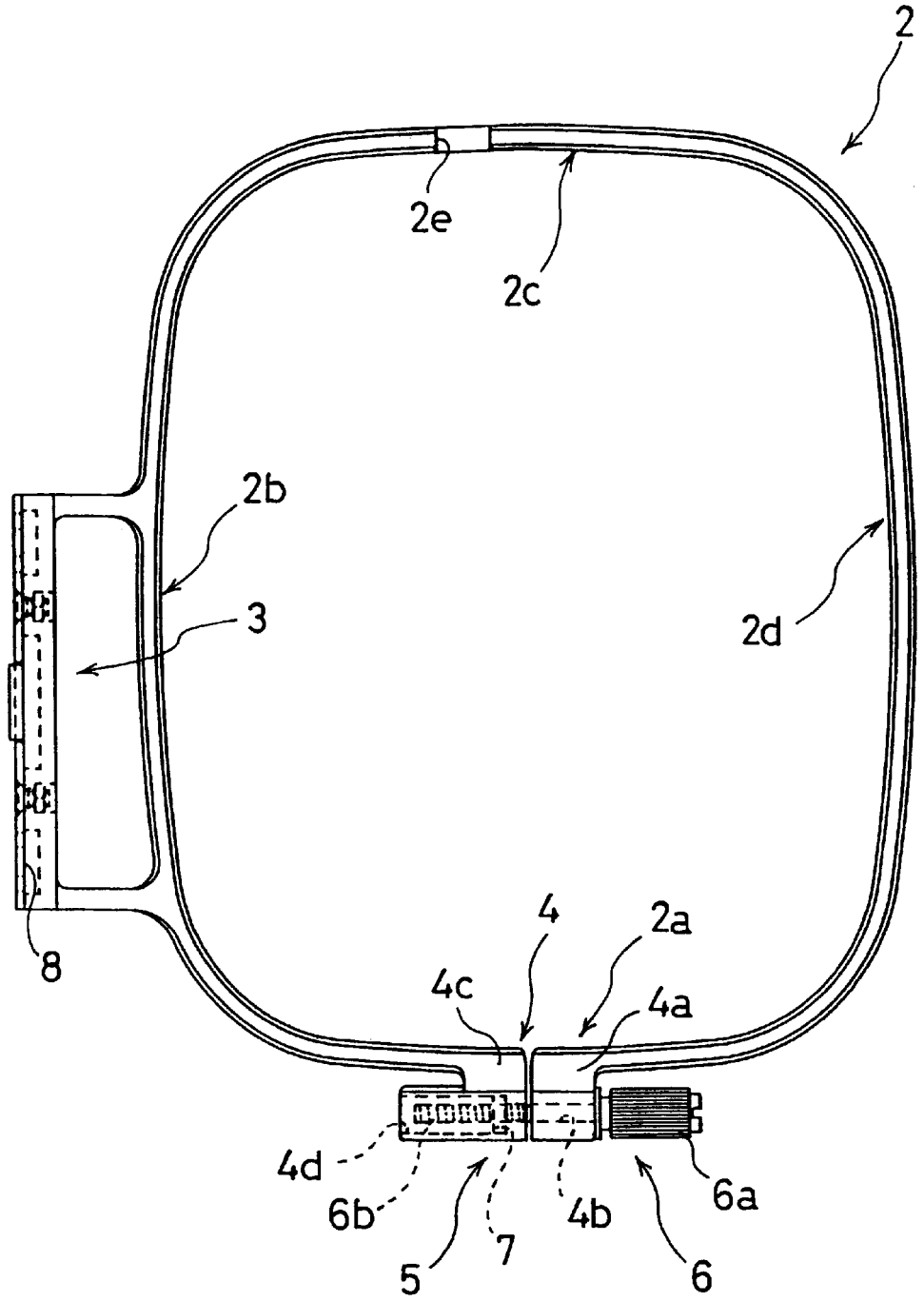
FIG. 2 is a plan view showing an outer frame of the embroidery frame of FIG. 1.

As shown in FIG. 1, an embroidery frame 1, used for describing the invention, has a generally rectangular shape as such a shape facilitates the explanation of the invention. The embroidery frame 1 comprises an outer frame 2 and an inner frame 10 which cooperate with each other to hold a work cloth W therebetween. The outer frame 2 includes four outer frame segments 2*a*–2*d* that are formed as an integral frame body having a substantially rectangular shape, as shown in FIG. 2. One of the outer frame segments 2*b* is formed with a mounting portion 3 to which a driving unit of a frame drive device (not illustrated) is coupled.

The outer frame segment 2*a* includes a split portion 4 at which the segment 2*a* is split at its middle portion as viewed in the longitudinal direction thereof, that is, the split portion 4 corresponds to a single split portion at which the outer frame 2 is split at one location in the circumferential direction thereof. The split portion 4 includes a pair of separate end portions 4*a*, 4*c* that protrude outwards, and a fastening mechanism 5 is attached to both of the separate end portions 4*a*, 4*c*. More specifically, one of the separate end portions 4*a* is formed with a through-hole 4*b* through which a fastening screw 6 is inserted, and the other end portion 4*c* is formed with an elongated recessed portion 4*d* having a hexagonal cross section and extending over a suitable length. A nut 7 is fitted in the deep end of the recessed portion 4*d*. A threaded portion 6*b* of the fastening screw 6 passing through the through-hole 4*b* is screwed into the nut 7.

Figure 6:
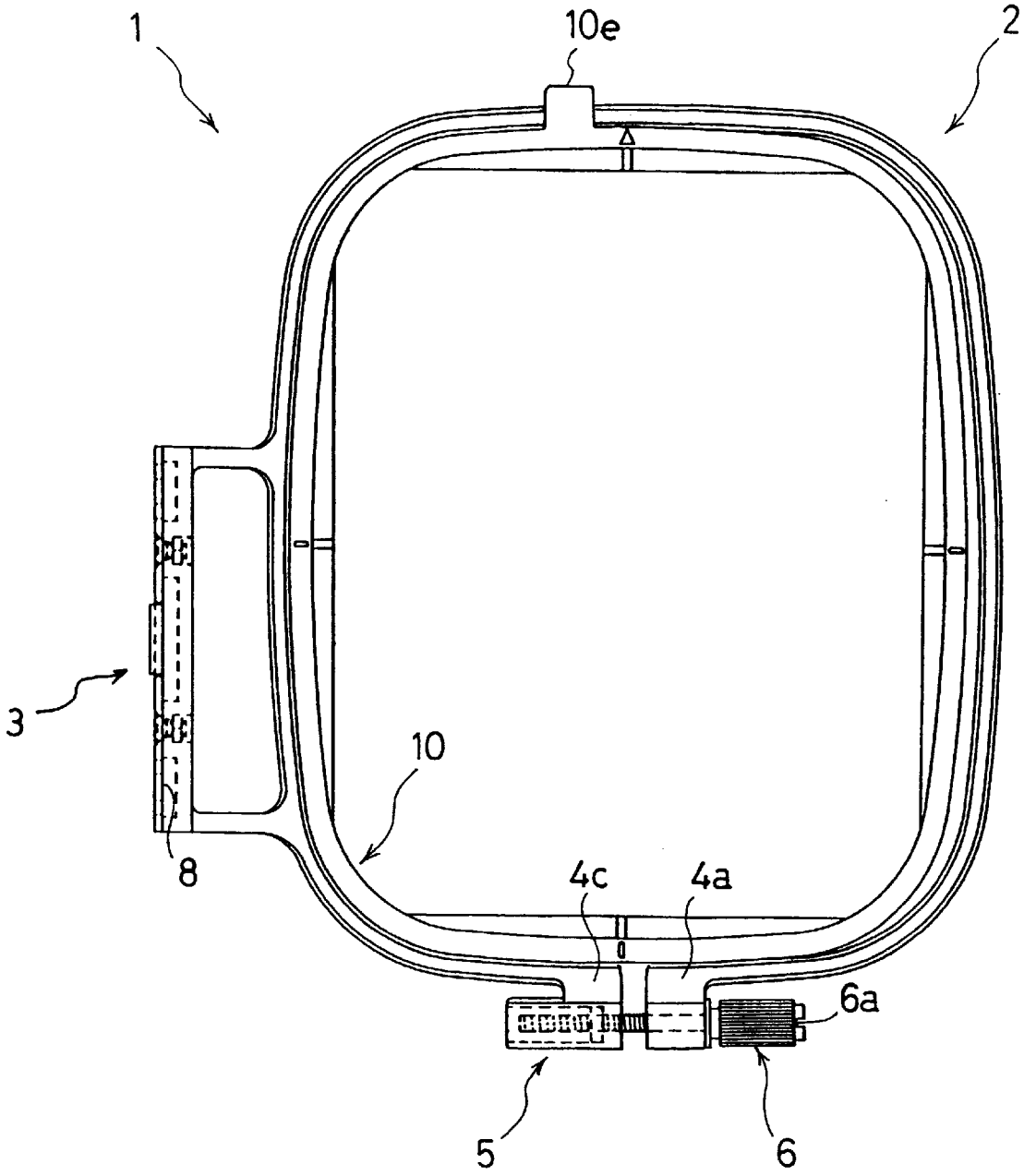
FIG. 6 is a view corresponding to that of FIG. 1, which is useful in explaining an operation to attach the inner frame to the outer frame.

When a top portion 6*a* of the fastening screw 6 is rotated in the fastening direction, namely, in the clockwise direction, the nut 7 engaging with the threaded portion 6*b* causes the separate end portions 4*a*, 4*c* to approach each other until the portions 4*a*, 4*c* substantially abut on each other as shown in FIG. 1. As a result, the outer frame 2 is fastened onto the inner frame 10. When the top portion 6*a* of the fastening screw 6 is rotated in the loosening direction, namely, in the counterclockwise direction, the separate end portions 4*a*, 4*c* are spaced apart from each other, as shown in FIG. 6, so that the fastening force exerted by the outer frame 2 to the inner frame 10 is reduced or removed, and the outer frame 2 is released from the inner frame 10.

An engaging plate 8 that extends in the vertical direction is attached to the mounting portion 3 of the outer frame 2, and is formed with engaging notches (not shown) that may engage with flanges formed at distal ends of a pair of horizontal engaging pins (not shown) provided on the drive unit of the frame drive device.

As shown in FIG. 2, the outer frame segment 2*c*, that is opposed to the outer frame segment 2*a* provided with the fastening mechanism 5, includes an engaging recess 2*e* having suitable width and depth, which is formed in a surface portion of the segment 2*c* that is located to the left of center, i.e., off center which can be either to the left or right of the center line (left being used in this description), as viewed in the longitudinal direction.

Figure 3:
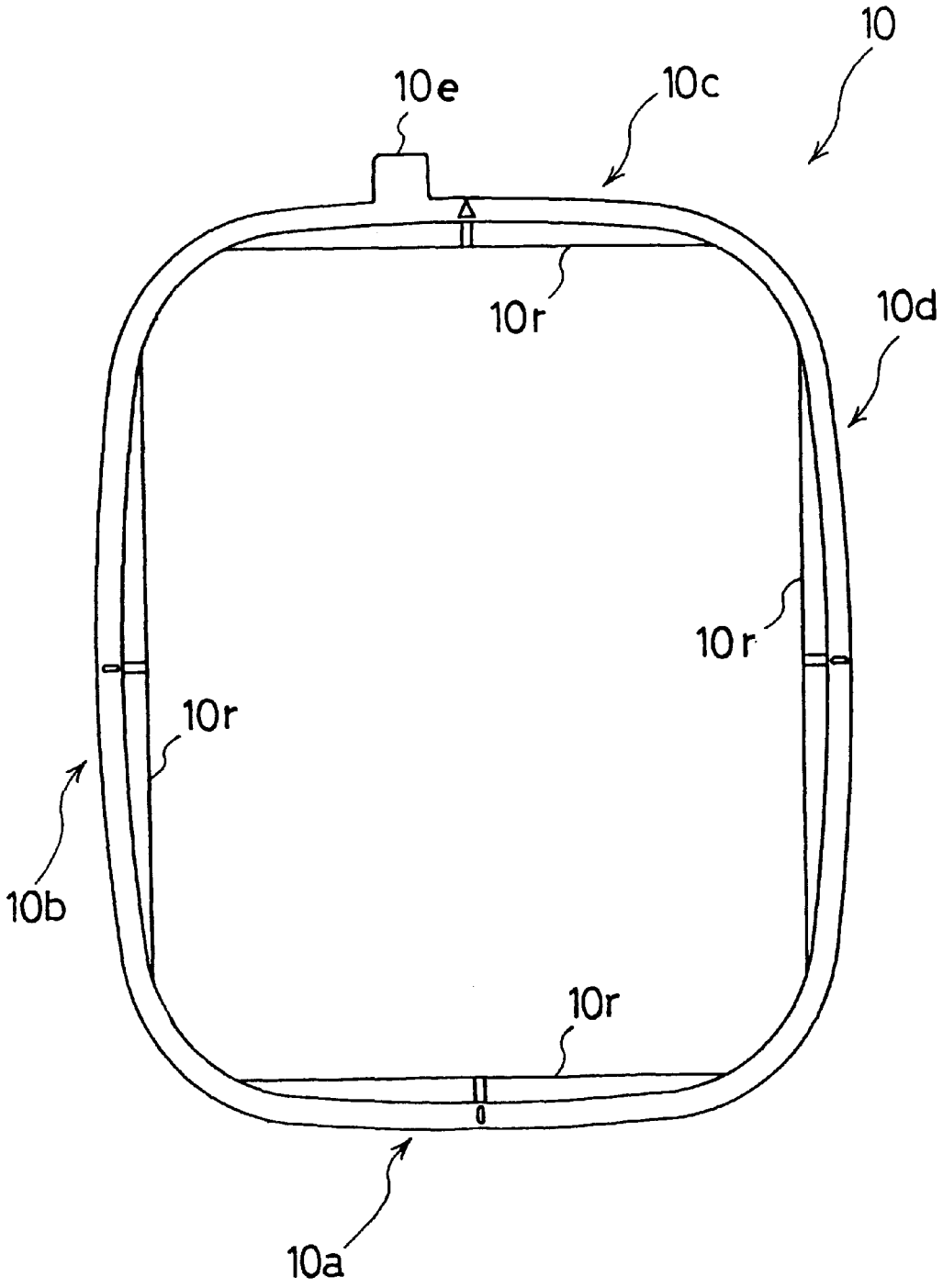
FIG. 3 is a plan view showing an inner frame of the embroidery frame of FIG. 1.
Figure 4:
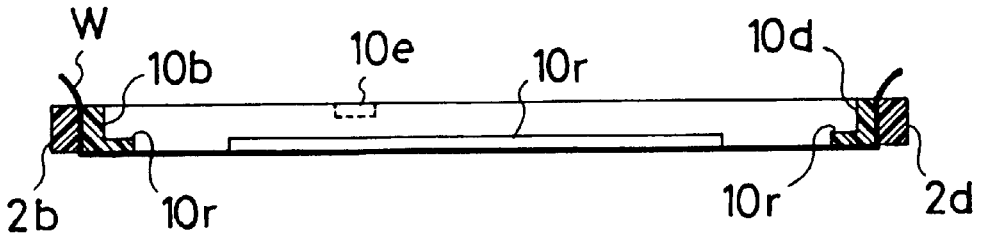
FIG. 4 is a cross-sectional view taken along line 4—4 of FIG. 1.
Figure 5:
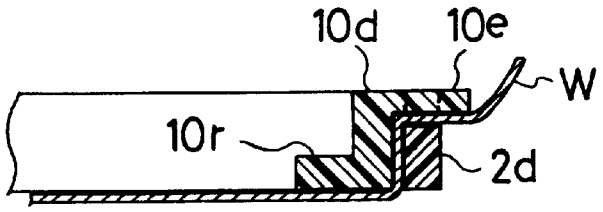
FIG. 5 is a cross-sectional view taken along line 5—5 of FIG. 1.

The inner frame 10 consists of four inner frame segments 10*a*–10*d* formed as an integral frame body having a generally rectangular shape, as shown in FIG. 3. As shown in FIGS. 3 through 5, ribs 10*r* are formed on lower portions of inner circumferences of the respective inner frame segments 10*a*–10*d*, so as to reinforce the inner frame 10, and also increase the tension of the work cloth W when the inner frame 10 cooperates with the outer frame 2 to hold the work cloth W. Further, a surface portion of the inner frame segment 10*c* that faces the engaging recess 2*e* of the outer frame 2 is formed with an engaging protrusion 10*e* capable of engaging with the recess 2*e*, such that the engaging protrusion 10*e* is located to the left of center, i.e., off center which can be either to the left or right of the center line, of the inner frame segment 10*c* as viewed in the longitudinal direction.

The length of the engaging protrusion 10*e* as described above is determined so that the protrusion 10*e* protrudes outwardly of the outer periphery of the outer frame 2 when the inner frame 10 is fitted in the outer frame 2, and thus serves as a tab to be used when the inner frame 10 is detached or removed from the outer frame 2.

Next, the operation and effect of the embroidery frame 1 structured as described above will be described.

Initially, the outer frame 2 is placed on a table such that its engaging recess 2*e* faces upwards, as shown in FIG. 6. Then, the top portion 6*a* of the fastening screw 6, of the fastening mechanism 5 is rotated in the loosening direction so that the outer frame 2 is loosened with respect to the inner frame 10. In this state, a work cloth W on which an embroidery pattern is to be formed is positioned and placed over the upper side of the outer frame 2. The inner frame 10, which is oriented such that its engaging protrusion 10*e* faces upwards, is then pressed downwards against the upper surface of the work cloth W, while the inner frame 10 is being positioned so that the engaging protrusion 10*e* engages with the engaging recess 2*e* of the outer frame 2. In this manner, the inner frame 10 is fitted inside the outer frame 2 with the work cloth W sandwiched therebetween.

In this state, since the engaging protrusion 10*e* is formed at the position that is spaced to the left of center of the inner frame segment 10*c* as viewed in its longitudinal direction, the user can easily tell the front side of the inner frame 10 at a glance from the position at which the engaging protrusion 10*e* is formed. Even in the case where a beginner places the outer frame 2 upside down, for example, he/she will soon notice the misplacement of the outer frame 2 since no engaging recess 2*e* is present on the outer frame 2 for engagement with the engaging protrusion 10*e* of the inner frame 10.

In the above manner, the outer frame 2 is correctly oriented and placed on the table so that the front side of the outer frame 2 faces upward, and then the work cloth W is laid over the outer frame 2 again. When the inner frame 10 is finally fitted in the outer frame 2, the engaging protrusion 10*e* comes into engagement with the engaging recess 2*e*. If the inner frame 10 cannot be fitted into the outer frame 2, the user will more likely determine the rear side of the inner frame 10 faces upwards, namely, the inner frame 10 is in the reversed state. In this case, the inner frame 10 is oriented so that its front side faces upward, and thus can be correctly fitted in the outer frame 2. Because the ribs 10*f* are located on the lower portion of the inner circumferential surface of the inner frame 10, the work cloth W can be attached to the embroidery frame 1 to stretch over the aperture of the embroidery frame 1 under high tension, without forming creases or wrinkles.

Next, the top portion 6*a* of the fastening screw 6 is rotated in the fastening direction, as shown in FIG. 1, so that the outer frame 2 is fastened onto the inner frame 10. Because the engaging protrusion 10*e* is provided on the inner frame segment 10*a* opposite to the outer frame segment 2*a* provided with the fastening mechanism 5, the fastening operation with the top portion 6 can be accomplished without being disturbed or affected by the engaging protrusion 10*e*. Also, the fastening mechanism 5 can fasten the separate end portions 4*a*, 4*c* so that the portions 4*a*, 4*c* almost adhere to each other, as the engaging protrusion 10*e* is not an obstacle to the fastening operation. As a result, the work cloth W is sandwiched between the outer frame 2 and the inner frame 10 over the entire circumference thereof, and the entire cloth can be stretched with substantially uniform force without suffering from local reduction in the tensile force at a split portion 4. Thus, the work cloth W set in the embroidery frame 1 is free from creases that may cause a problem during embroidery sewing.

The embroidery frame 1 in which the work cloth W is set in the above manner is then moved to the location of the frame drive device, and the engaging notches of the engaging plate 8 are brought into engagement with the engaging pins of the driving unit of the frame drive device so that the embroidery frame 1 is attached to the frame drive device. Because only a small clearance is normally present between the engaging pins of the frame drive device and a needle plate (board) of a sewing table, it is impossible to attach the engaging plate 8 of the embroidery frame 1 to the lower side of the engaging pins, and therefore the embroidery frame 1 can be correctly oriented and attached to the drive unit of the frame drive device such that the front side of the embroidery frame 1 faces upwards.

When the embroidery frame 1 is detached from the frame drive device upon completion of embroidery sewing, on the other hand, the inner frame 10 can be easily removed from the outer frame 2 since the engaging protrusion 10*e* of the inner frame 10, which protrudes from the outer periphery of the outer frame 2, serves as a tab that can be grasped by his/her fingers and lifted up.

Referring next to FIGS. 7 through 10, other embodiments of the invention will be now described.

Figure 7:
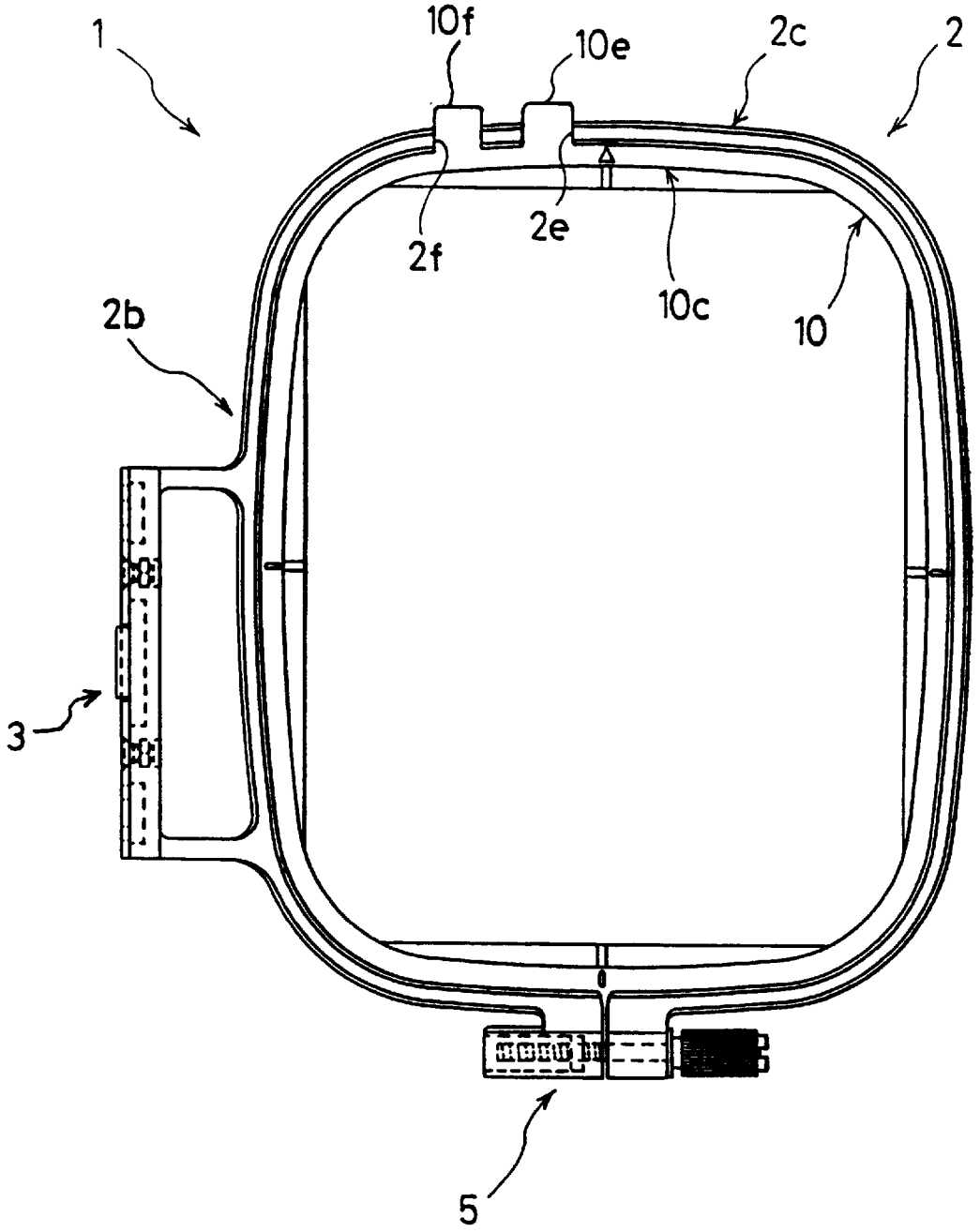
FIG. 7 is a plan view showing an embroidery frame according to another embodiment of the invention.

In the embodiment shown in FIG. 7, two pairs of engaging recesses and engaging protrusions are provided on the frame segments 2*c*, 10*c* that are opposed to the fastening mechanism 5, such that the recesses and protrusions are located to the left, i.e., close to the frame segment 2*d*, of center (they could also be to right of center) of the frame segments 2*c*, 10*c*. Namely, engaging recesses 2*e*, 2*f* are formed at positions closer to the outer frame segment 2*b* with respect to the lengthwise middle portion of the outer frame segment 2*c*, and engaging recesses 10*e*, 10*f* capable of engaging with the respective recesses 2*e*, 2*f* are provided on the inner frame segment 10*c*. With this arrangement in which two pairs of engaging protrusions and engaging recesses are provided, the outer frame and inner frame engage with each other at two locations, and therefore the inner frame can be more firmly fitted in the outer frame.

Figure 8:
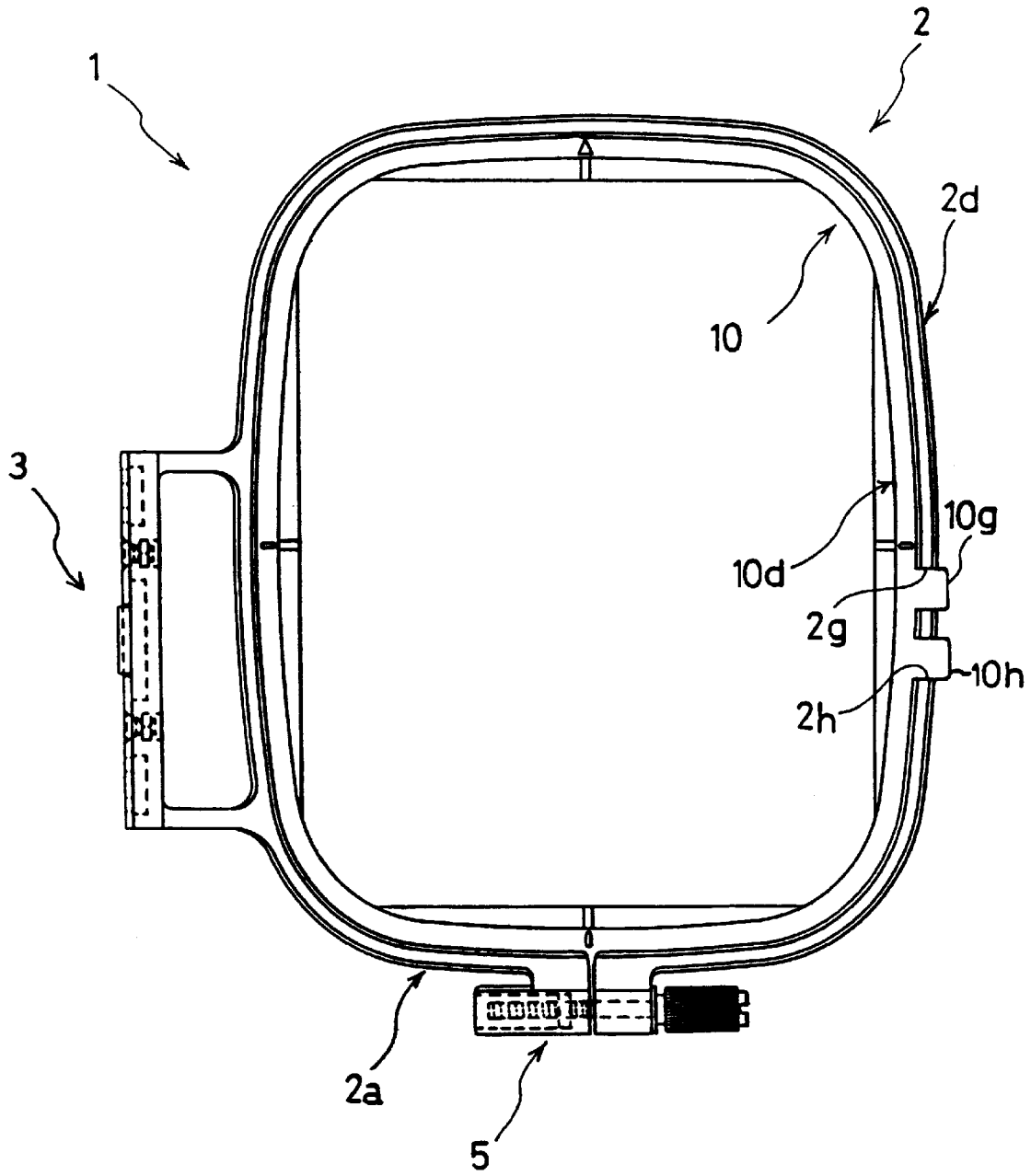
FIG. 8 is a plan view showing an embroidery frame according to a further embodiment of the invention.

In the embodiment shown in FIG. 8, two pairs of engaging recesses and engaging protrusions are provided on the outer and inner frame segments 2*d*, 10*d*, respectively, located next to or adjacent to the outer frame segment 2*a* on which the fastening mechanism 5 is provided. Namely, engaging recesses 2*g*, 2*h* are formed in the outer frame segment 2*d* at its positions closer to the frame segment 2*a* with respect to the lengthwise middle portion thereof (alternatively they could be at positions further from or a combination of positions), and engaging protrusions 1O*g*, 10*h* capable of engaging with the corresponding recesses 2*g*, 2*h* are provided at complementary positions on the inner frame segment 10*d*.

Figure 9:
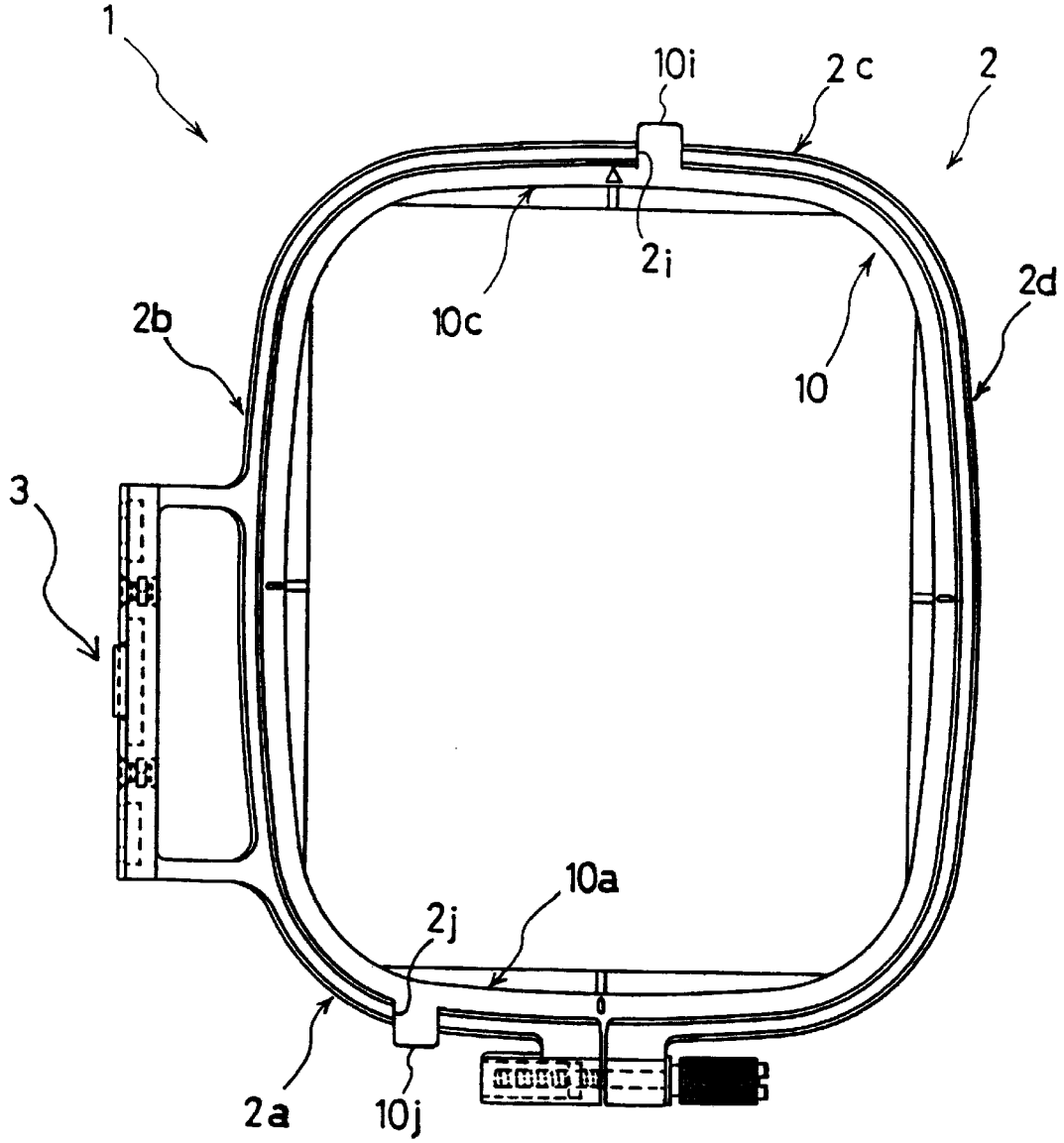
FIG. 9 is a plan view showing an embroidery frame according to a still further embodiment of the invention.

In the embodiment shown in FIG. 9, two pairs of engaging recesses and engaging protrusions are respectively provided on the opposite frame segments. More specifically, an engaging recess 2*i* is formed in a portion of the outer frame segment 2*c* that is spaced from the center portion thereof toward the outer frame segment 2*d*, and an engaging protrusion capable of engaging with the recess 2*i* is formed on the corresponding portion of the inner frame segment 10*c*. On the other hand, an engaging recess 2*j* is formed in a portion of the outer frame segment 2*a* that is opposed to the outer frame segment 2*c*, which portion is spaced from the center portion of the frame segment 2*a* toward the outer frame segment 2*b*, and an engaging protrusion 10*j* capable of engaging with the recess 2*j* is formed on the corresponding portion of the inner frame segment 10*a*. Other opposing, but offset positions could also be used for the engaging recesses and engaging protrusions.

Since one pair of engaging recess and protrusion and the other pair of engaging recess and protrusion are provided on the frame segments on the opposite sides of the aperture of the frame, the entire inner frame can be firmly fitted in the outer frame due to the engagement of the recesses with the protrusions at the opposite frame segments.

Figure 10:
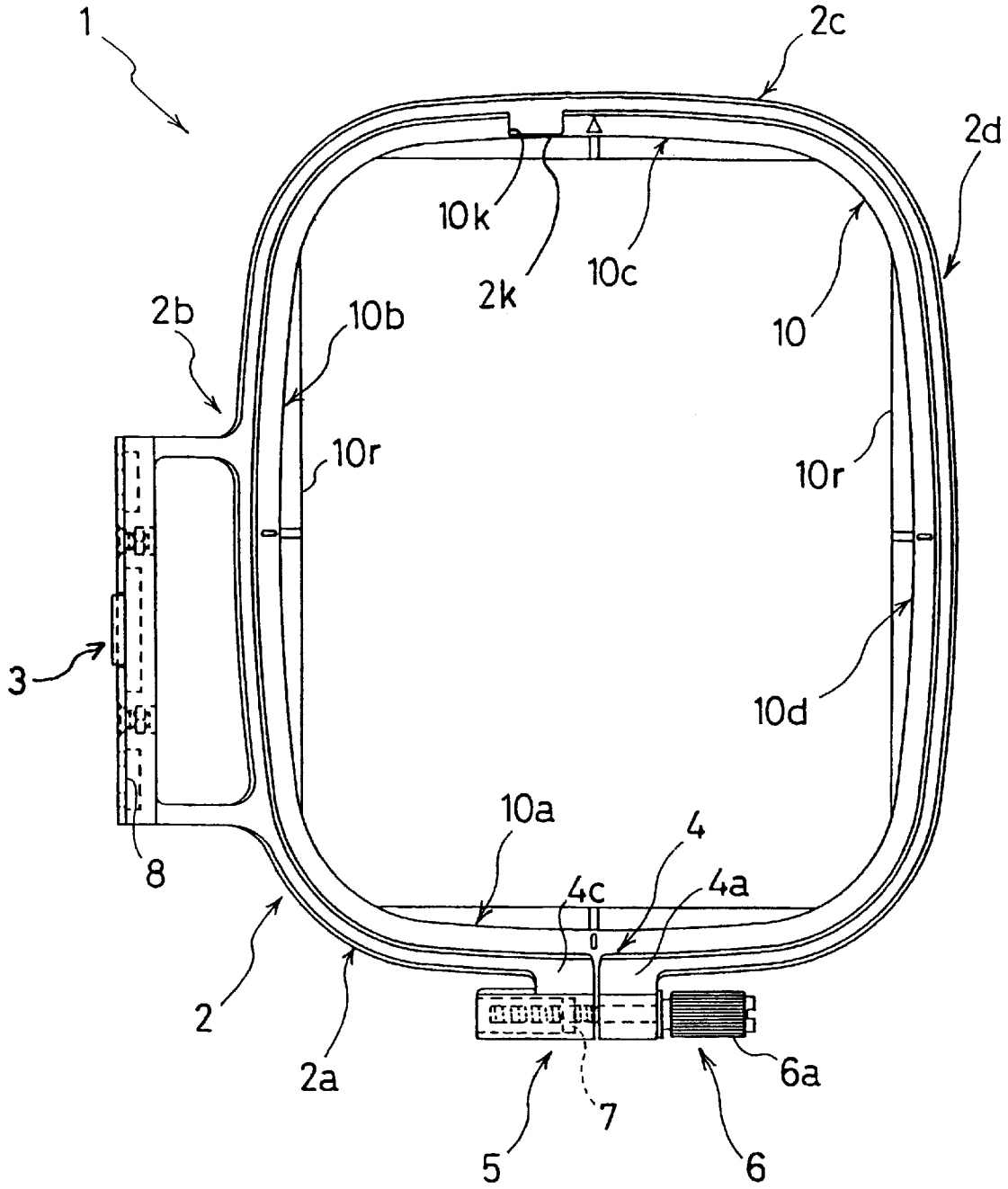
FIG. 10 is a plan view showing an embroidery frame according to a still another embodiment of the invention.
Figure 11:
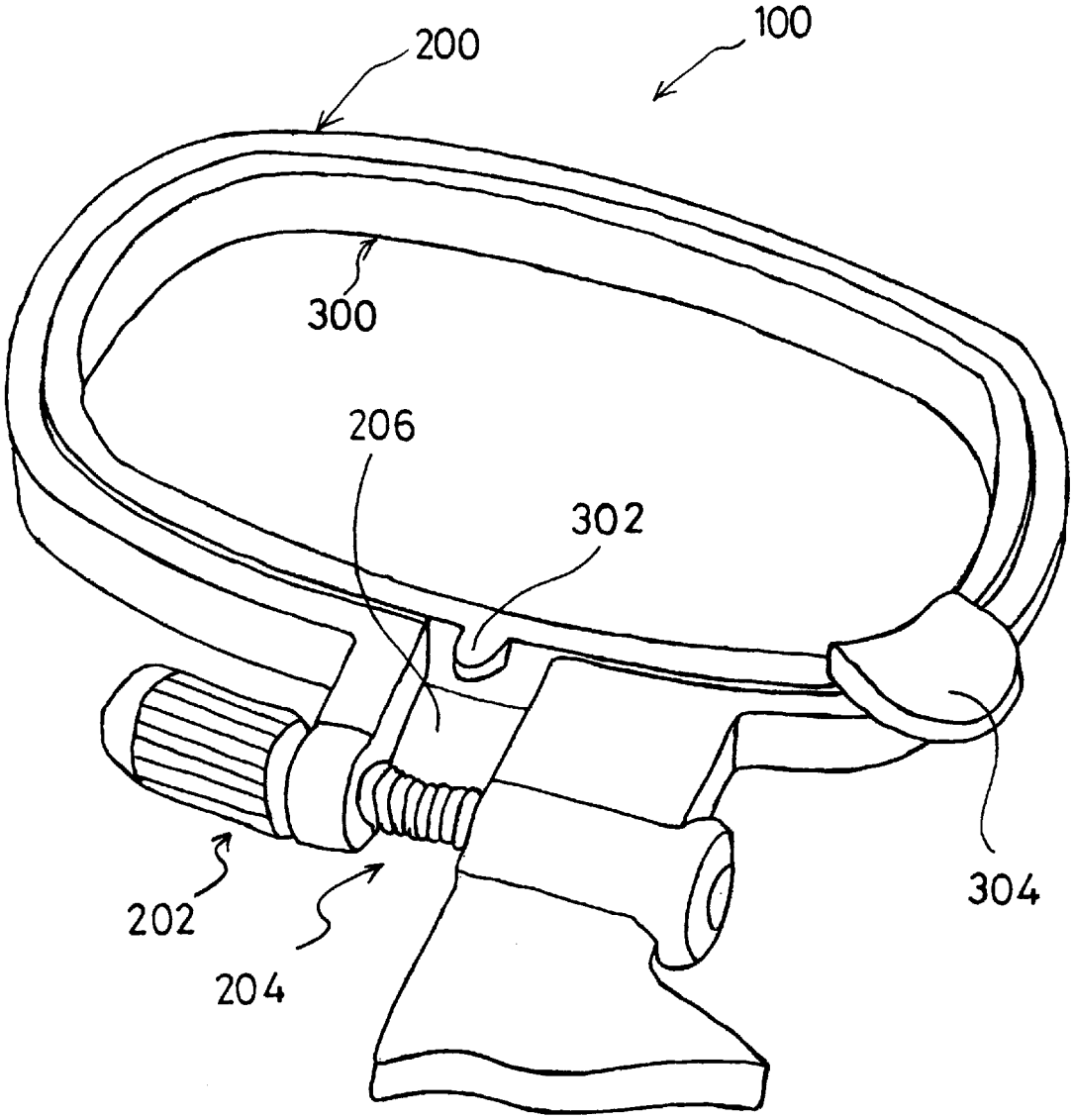
Fig.11 PRIOR ART
FIG. 11 is a perspective view showing a conventional embroidery frame.

The embodiment as shown in FIG. 10 is different from the illustrated embodiments in that an engaging protrusion 2*k* is formed on the outer frame 2, and an engaging recess 10*k* adapted to engage with the protrusion 2*k* is formed in the inner frame 10*k*.

While some embodiments of the invention have been described above, for illustrative purpose only, the invention may be otherwise embodied with various changes in the shape, structure, combination of components, or the like, without departing from the principle of the invention.

For example, the inner frame and outer frame of the illustrated embodiments have a generally rectangular shape, but may have a circular, elliptic or any other shape.

In the embroidery frame as shown in FIG. 1, the engaging recess 2*e* is located to the left with respect to the center of the relevant frame segment. It is, however, possible to form the engaging recess 2*e* in the middle portion of the frame segment, or locate the recess 2*e* to the right with respect to the center of the frame segment.

It is to be understood that the invention may be applied to various types of embroidery frames to be attached to embroidery frame driving units for various sewing machines, such as embroidery sewing machines that incorporate embroidery devices therein, or sewing machines to which or from which embroidery devices may be attached or detached to complete sewing operations.

What is claimed is:

1. An embroidery frame for an embroidery machine, comprising:

an outer frame to be attached to a driving unit of a frame drive device, said outer frame including a split portion formed at at least one location as viewed in a circumferential direction thereof, said split portion including a pair of separate end portions;

an inner frame that cooperates with said outer frame to sandwich a work cloth therebetween; and a fastening mechanism operable to fasten the pair of separate end portions of the split portion of the outer frame in such a direction that the separate end portions approach each other, wherein an engaging recess is formed in an upper face of a portion of one of the outer frame and the inner frame that excludes the split portion, and an engaging protrusion adapted to engage with the engaging recess is formed on the upper face of the other of the outer frame and the inner frame.

2. The embroidery frame according to claim 1, wherein the engaging recess is located at a position on the embroidery frame that is substantially opposed to a position on the frame to which the fastening mechanism is attached.

3. The embroidery frame according to claim 1, wherein each of the outer frame and the inner frame has a generally rectangular shape, and comprises first, second, third and fourth frame segments, wherein the fastening mechanism is attached to the first frame segment of the outer frame, while the engaging recess is formed in one of the second, third and fourth frame segments of said one of the outer frame and inner frame.

4. The embroidery frame according to claim 3, wherein the engaging recess is formed in the second frame segment of said one of the outer frame and the inner frame that is opposed to the first frame segment of the outer frame to which the fastening mechanism is attached, such that a central open portion of the embroidery frame is interposed between the first frame segment and the second frame segment.

5. The embroidery frame according to claim 3, wherein the engaging recess is formed at a position that is spaced from a middle portion of said one of the second, third and fourth frame segments as viewed in a longitudinal direction thereof.

6. The embroidery frame according to claim 1, wherein the engaging recess and the engaging protrusion comprise a plurality of pairs of engaging recesses and engaging protrusions.

7. The embroidery frame according to claim 6, wherein said plurality of pairs of engaging recesses and engaging protrusions are respectively provided at substantially opposed positions on the frame that are opposed to each other with a central open portion of the frame interposed therebetween.

8. The embroidery frame according to claim 1, wherein the engaging recess is provided on the outer frame, and the engaging protrusion is provided on the inner frame.

9. The embroidery frame according to claim 8, wherein the engaging recess is located at a position of the outer frame that is substantially opposed to the fastening mechanism.

10. The embroidery frame according to claim 8, wherein each of the outer frame and the inner frame has a generally rectangular shape, and comprises first, second, third and fourth frame segments, and wherein the fastening mechanism is attached to the first frame segment of the outer frame, and the engaging recess is formed in one of the second, third and fourth frame segments of the outer frame.

11. The embroidery frame according to claim 10, wherein the engaging recess is formed in the second frame segment of the outer frame that is opposed to the first frame segment to which the fastening mechanism is attached, such that a central open portion of the embroidery frame is interposed between the first frame segment and the second frame segment.

12. The embroidery frame according to claim 10, wherein the engaging recess is formed at a position that is spaced from a middle portion of said one of the second, third and fourth frame segments as viewed in a longitudinal direction thereof.

13. The embroidery frame according to claim 8, wherein said engaging protrusion comprises a tab that protrudes outwardly of an outer periphery of the outer frame.

14. An embroidery frame according to claim 8, wherein the engaging recess and the engaging protrusion comprise a plurality of pairs of engaging recesses and engaging protrusions.

15. The embroidery frame according to claim 1, wherein the engaging recess is provided on the side of a lower face of the inner frame, and the engaging protrusion is provided on the outer frame.

16. The embroidery frame according to claim 1, wherein the engaging recess and the engaging protrusion snugly engage with each other with substantially no clearance therebetween.

17. An embroidery frame for mounting to an embroidery position control system of a sewing machine, composing:

an outer frame having:

a mounting mechanism for attachment to the embroidery position control system;

an opening joined by a closing mechanism; and at least one of a recess and a tab located on an upper edge surface of the outer frame and separated from both the opening and the mounting mechanism; and an inner frame that is received in the outer frame, the inner frame having a complementary other of the at least one of a recess and a tab located on an upper edge surface of a corresponding edge and mating with the at least one of a recess and a tab on the outer frame.

18. The embroidery frame according to claim 17, wherein the closing mechanism substantially closes the outer frame to provide a continuous outer frame and hold the inner frame within the outer frame.

19. The embroidery frame according to claim 17, wherein the closing mechanism comprises:

a first end portion, at a first side of the opening in the outer frame, having a through hole;

a second end portion, at a second side of the opening in the outer frame, having internally threaded member housed therein; and a fastening screw passing through the through hole in the first end portion and being threadably received in the threaded member in the second end portion.

20. The embroidery frame according to claim 17, wherein the embroidery frame is one of square, rectangular, circular, and oval.

* * * * *